US005559540A

United States Patent [19]

Burolla

[11] Patent Number: 5,559,540

[45] Date of Patent: Sep. 24, 1996

[54] APPARATUS AND METHOD FOR PROVIDING A HYDROPHOBIC COATING ON AN INK JET PRINTING HEAD

[75] Inventor: Vincent A. Burolla, Ontario, N.Y.

[73] Assignee: Xerox Corporation, Stamford, Conn.

[21] Appl. No.: 274,089

[22] Filed: Jul. 12, 1994

[51] Int. Cl.[6] ..... B41J 2/165

[52] U.S. Cl. ..... 347/45; 347/33

[58] Field of Search ..... 347/33, 45

[56] References Cited

U.S. PATENT DOCUMENTS 5,005,024 4/1991 Takahashi et al. ..... 347/33

OTHER PUBLICATIONS

1992 Brochure and Advertisement by the Mobil Corporation for Ultra Tripledge® Windshield Wipers.

*Primary Examiner*—Valerie A. Lund
*Attorney, Agent, or Firm*—Oliff & Berridge

[57] ABSTRACT

The invention is an apparatus and method for periodically applying a hydrophobic coating layer to a face of an ink jet printing head to prevent droplets of ink from clogging nozzles of the printing head. An ink jet printer embodying the invention includes a hydrophobic material applicator that moves relative to the printing head to deposit hydrophobic material on the face of the ink jet printing head. The applicator may be a wiper blade or cylinder made from a hydrophobic material or embedded with a hydrophobic material, wherein the applicator contacts the face of the printing head during relative movement to transfer hydrophobic material to the printing head. The applicator may also be a spray head that sprays hydrophobic material onto the face of the printing head during relative movement.

12 Claims, 3 Drawing Sheets

APPARATUS AND METHOD FOR PROVIDING A HYDROPHOBIC COATING ON AN INK JET PRINTING HEAD

BACKGROUND OF THE INVENTION

1. Field of the Invention

This invention relates to apparatus and methods for providing a hydrophobic coating on the face of an ink jet printing head to prevent droplets of ink from clinging to the face of the printing head and clogging the ink jet nozzles.

2. Description of Related Art

It is known in the art to provide a hard, diamondlike hydrophobic coating on the face of an ink jet printing head to prevent droplets of ink from clinging to the face of a printing head and clogging the ink jet nozzles. The hydrophobic coating layer is adhered to the face of the ink jet printing head during manufacture. The prior art hydrophobic coating layers are relatively expensive to produce, and they add significantly to the cost of manufacturing ink jet printing heads.

SUMMARY OF THE INVENTION

The invention is an apparatus and method for periodically depositing a hydrophobic material on the face of an ink jet printing head to provide a hydrophobic coating layer which is periodically refreshed. An ink jet printer embodying the invention includes an applicator supported by the printer so that the printing head will periodically move past the applicator as it translates back and forth within the printer to print characters on a sheet of paper. As the printing head moves past the applicator, the applicator deposits hydrophobic material on the face of the printing head to provide a hydrophobic coating layer.

The applicator for depositing hydrophobic material may be in the form of a wiper blade, a rotating cylinder, or a spray nozzle. In the case of a wiper blade or a rotating cylinder, movement of the printing head relative to the wiper blade or rotating cylinder may cause the face of the printing head to contact the applicator. The applicator may be comprised of a hydrophobic material, or hydrophobic material may be embedded in the applicator. In either case, the contact between the applicator and the face of the printing head causes hydrophobic material to be deposited on the face of the printing head. In the case of a spray nozzle, the spray nozzle may periodically spray hydrophobic material onto the face of the printing head as it moves past the nozzle to refresh the hydrophobic coating.

Depositing hydrophobic material on the face of an ink jet printing head according to the present invention provides all the benefits of the prior art diamond-like hydrophobic coatings. Because the materials used in the present invention are less expensive, and because no expensive coating process is required, the present invention provides a low cost method for periodically applying a hydrophobic coating layer on the surface of an ink jet printing head.

BRIEF DESCRIPTION OF THE DRAWINGS

The invention will be described in detail with reference to the following figures wherein like elements bear like reference numerals and wherein.

DETAILED DESCRIPTION OF THE PREFERRED EMBODIMENTS

Figure 1:
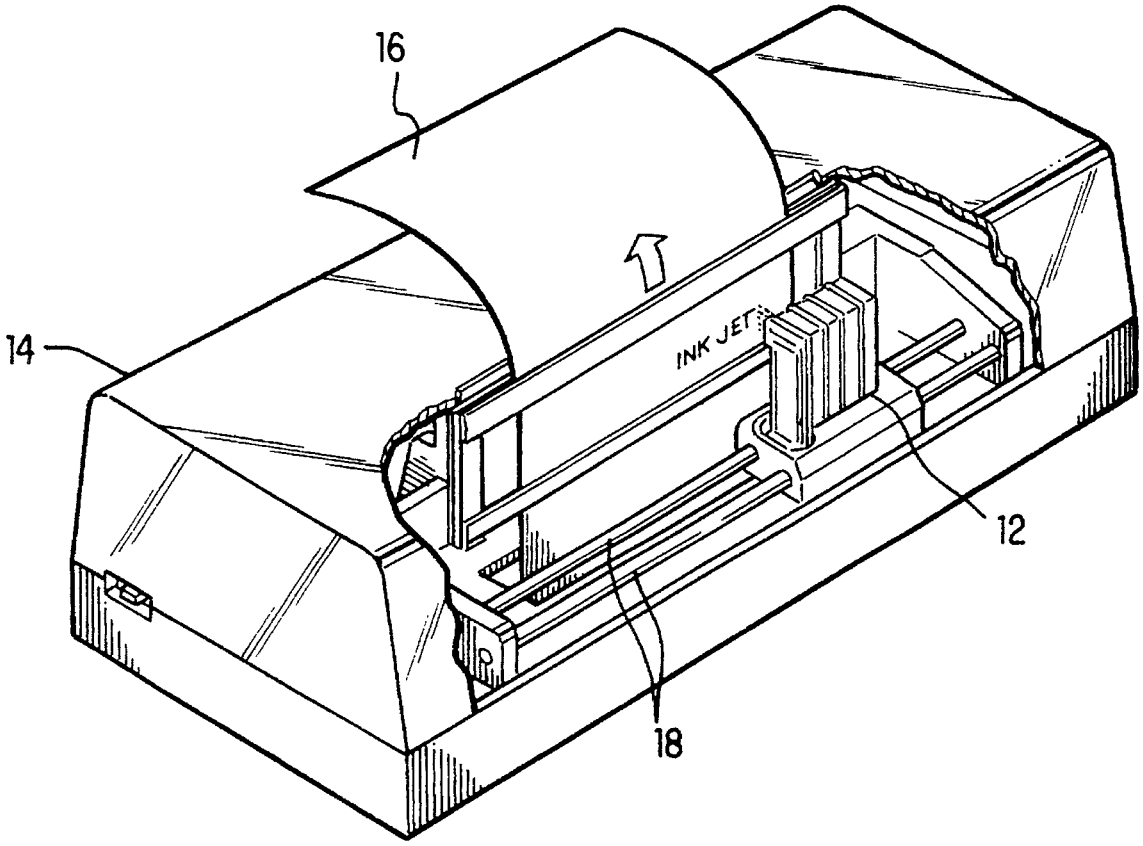
FIG. 1 is a perspective view of a prior art ink jet printer.

A prior art ink jet printer is shown in FIG. 1. The printer 14 includes an ink jet printing head 12 which is slidably mounted on rails 18 so that the printing head 12 can translate back and forth across a sheet 16 of paper inserted into the printer 14. In operation, the sheet 16 is held stationary while the ink jet printing head 12 translates across the rails 18 and ejects droplets of ink to form characters on the sheet 16. After a complete pass the sheet 16 is indexed up in the direction of the arrow, and the printing head 12 translates back across the rails 18 in the opposite direction to print a new line. This process repeats to print an entire page.

Figure 2:
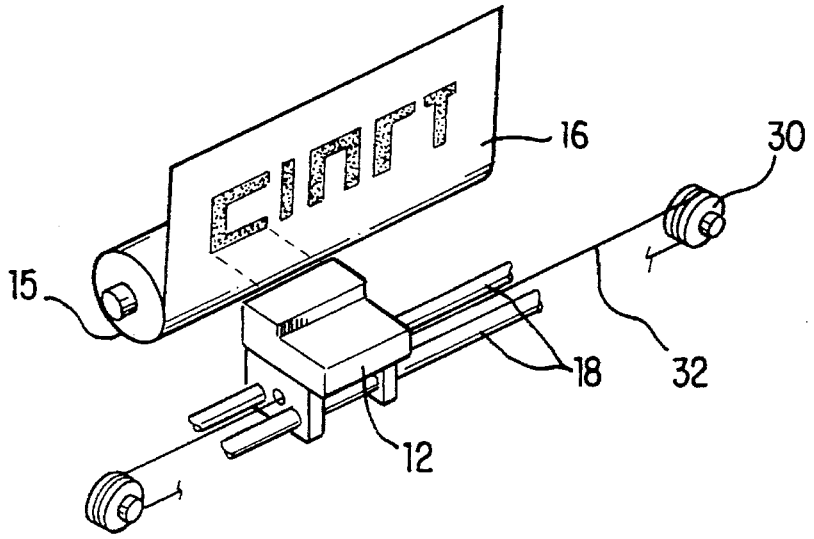
FIG. 2 is a perspective view of a prior art ink jet printing mechanism.
Figure 3:
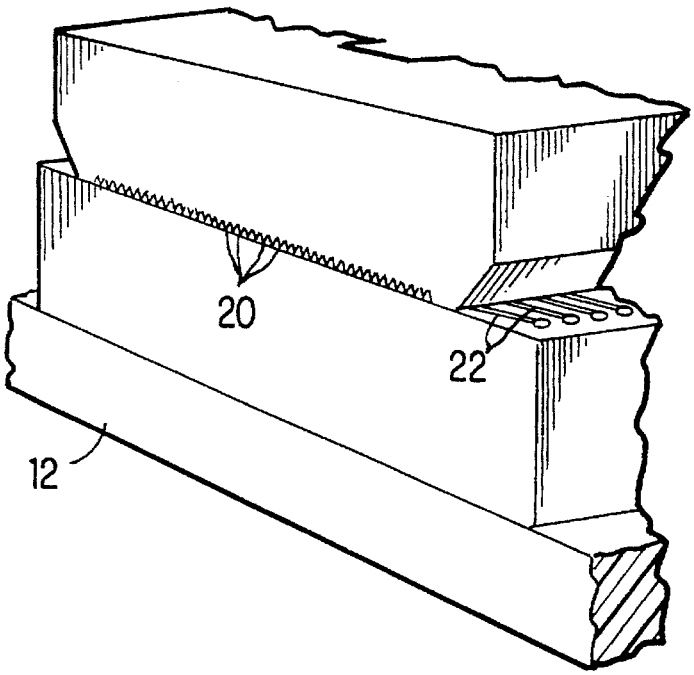
FIG. 3 is a perspective view of the face of an ink jet printing head.

The basic printing mechanism of a prior art ink jet printer is shown in FIG. 2. A platen 15 supports a sheet 16. An ink jet printing head 12 is slidably mounted on rails 18. Movement of a positioning cable 32 on rollers 30 causes the printing head 12 to slidably move along the rails An enlarged perspective view of a face of an ink jet printing head 12 is shown in FIG. 3. The ink jet printing head 12 has a plurality of ink jet nozzles 20 that eject droplets of ink to form characters on a page. Electrical impulses applied to contacts 22 control the ejection of ink droplets from the nozzles 20.

If a droplet of ink is adhered to the face of the ink jet printing head 12 so that it is partially or completely clogging one of the nozzles 20, the nozzle will be prevented from ejecting ink in a straight path directly onto a sheet adjacent the printing head. The clogging of a nozzle 20 causes distortion of the characters being formed by the printer. Accordingly, it is essential that no ink droplets are allowed to cling to the face of the ink jet printing head 12 since they can result in distorted printing.

Figure 4:
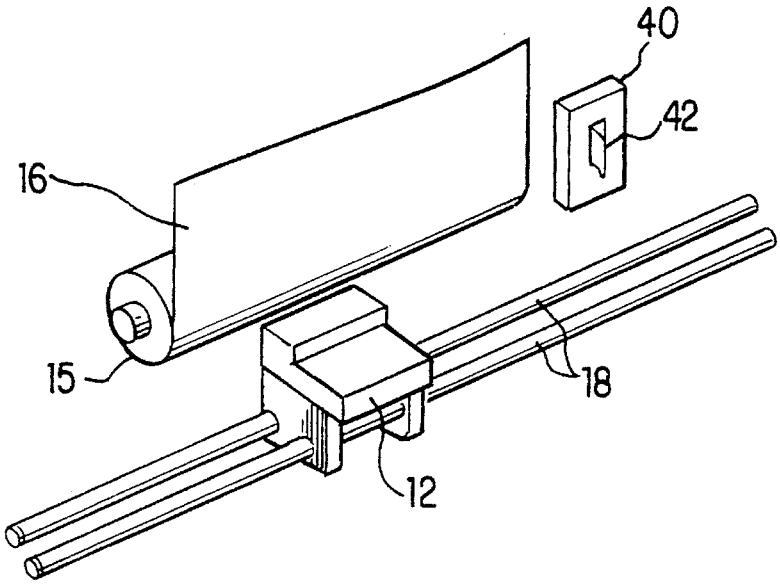
FIG. 4 is a perspective view of an ink jet printing mechanism and a wiper blade applicator according to the present invention.

FIG. 4 shows a first embodiment of an ink jet printing mechanism according to the present invention. A platen 15 supports a sheet 16, and an ink jet printing head 12, slidably mounted on rails 18, ejects droplets of ink onto the sheet 16 to form printed characters. An applicator assembly 40 having a wiper blade 42 is mounted adjacent the platen 15. The wiper blade 42 may be constructed of a hydrophobic material, or the wiper blade may be constructed of silicone sponge rubber, or any other suitable material that may be embedded with a hydrophobic material. One example of a hydrophobic material that may be used to construct a wiper blade 42 is a polydimethylsiloxane (PDMS) elastomer.

The applicator assembly 40 is positioned so that as the printing head 12 slides along the rails 18, the face of the printing head 12 contacts and wipes across the wiper blade 42. The sliding contact between the wiper blade 42 and the face of the printing head 12 causes hydrophobic material from the wiper blade 42 to be deposited on the face of the printing head 12. The hydrophobic material deposited on the printing head 12 provides a hydrophobic coating layer that prevents ink droplets from adhering to the face of the printing head 12 and clogging the nozzles.

Figure 5:
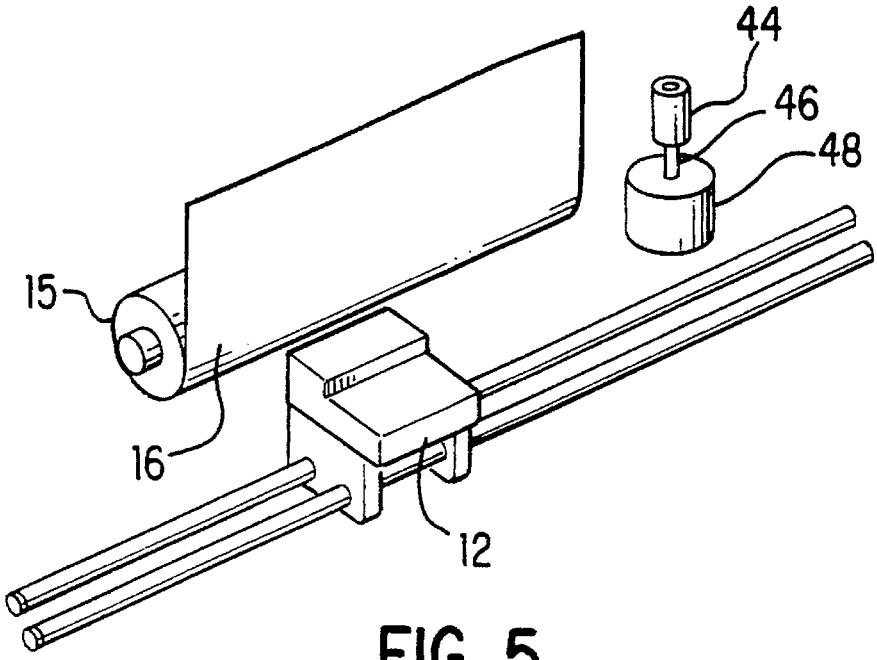
FIG. 5 is a perspective view of an ink jet printing mechanism and a rotating cylinder applicator according to the present invention.

In a second embodiment shown in FIG. 5, the applicator assembly comprises a rotating cylindrical applicator 44. The cylindrical applicator 44 may be made from a hydrophobic material, or it may be embedded with a hydrophobic material. The cylindrical applicator is mounted on the shaft 46 of an electric motor 48.

In this embodiment the electric motor 48 is activated when the face of the printing head 12 is translating past the cylindrical applicator 44. The rotating cylindrical applicator 44 brushes against the face of the printing head 12 to deposit hydrophobic material. The rotating cylindrical applicator 44 provides a method of increasing the amount of sliding surface contact between the applicator 44 and the face of the printing head 12, thereby increasing the amount of hydrophobic material deposited on the face of the ink jet printing head 12.

In an ink jet printer according to the present invention, continued use of the printer will cause the hydrophobic material of an applicator to be gradually depleted. In order to ensure that a suitable hydrophobic coating layer is maintained on the face of the ink jet printing head, the applicator may need to be periodically replaced.

Ink jet printers are commonly provided with replaceable ink reservoir cartridges. The ink reservoir cartridge is used until it runs out of ink, and then the entire cartridge is replaced with a new cartridge. It is anticipated that new hydrophobic material applicators according to the present invention could be included with replacement cartridges so that both elements may be replaced at the same time.

Figure 6:
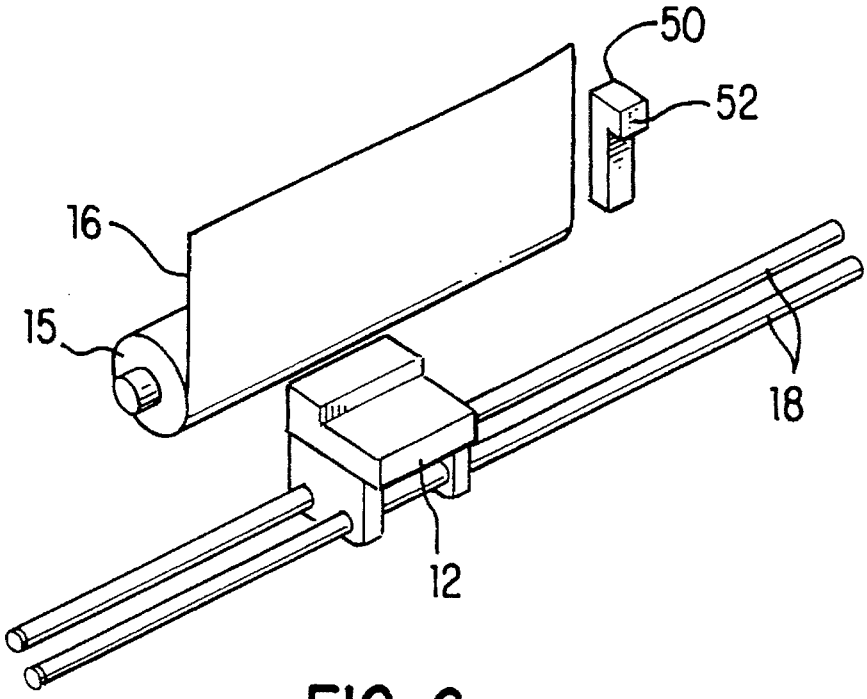
FIG. 6 is a perspective view of an ink jet printing mechanism and a spray nozzle applicator according to the present invention.

A third embodiment of the present invention is shown in FIG. 6. In the third embodiment the applicator assembly 50 comprises a nozzle assembly 52 adapted to spray hydrophobic material onto the face of the ink jet printing head as the printing head 12 translates past the applicator assembly 50. Hydrophobic material may be sprayed onto the face of the printing head 12 each time it passes the applicator assembly 50, or the material could be sprayed periodically. In this embodiment of the invention, the hydrophobic material could be stored in a reservoir and the reservoir could be periodically replenished. One example of a liquid hydrophobic material suitable for use in this embodiment is sold under the tradename RAIN-X, which is produced by UNELKO Corporation, Scottsdale, Ariz.

In an embodiment of the invention where a printing head is translating back and forth to print characters on a sheet, the printing head may translate past the applicator twice between printing lines of text, a first time after printing a first line of text, and a second time after the printing head has reversed direction but before it prints a second line of text. In addition, the invention is not limited to printers where the printing head moves. A printer where the printing head is stationary may be provided with a moving applicator so that the printing head and the applicator move relative to one another to deposit hydrophobic material on the printing head While the invention has been described in connection with the preferred embodiments, it will be understood that it is not intended to limit the invention of these embodiments. On the contrary, it is intended to cover all alternatives, modifications and equivalents as may be included within the spirit and scope of the invention as defined by the appended claims.

What is claimed is:

1. An ink jet printer, comprising:

means for supporting a recording medium;

an ink jet printing head, with droplet emitting nozzles on a nozzle face of the printing head, for printing on a recording medium;

an applicator, supported on the printer, for depositing a hydrophobic material on the nozzle face of the ink jet printing head; wherein said applicator comprises a solid hydrophobic material which is transferable to the nozzle face by sliding contact between applicator and the nozzle face;

means for moving the printing head in sliding contact with the applicator so that a portion of the solid hydrophobic material comprising the applicator is transferred to the nozzle face of the printing head during said sliding contact.

2. The ink jet printer of claim 1, wherein the printing head is slidably mounted on the printer and the recording medium support means and applicator are substantially fixed in the printer, and wherein the applicator is spaced from a path of slidable movement of the printing head so that movement of the printing head relative to the applicator causes the nozzle face of the printing head to contact the applicator, said contact causing a portion of the solid hydrophobic material comprising the applicator to be deposited on the nozzle face of the printing head.

3. The ink jet printer of claim 2, wherein a solid hydrophobic material is impregnated in the applicator, said sliding contact transferring a portion of said solid hydrophobic material from the applicator to the nozzle face of the printing head.

4. The ink jet printer of claim 2, wherein the applicator comprises a sponge rubber.

5. The ink jet printer of claim 2, wherein the applicator comprises a silicone rubber.

6. The ink jet printer of claim 2, wherein the applicator comprises a wiper blade.

7. The ink jet printer of claim 2, wherein the applicator comprises a cylinder.

8. The ink jet printer of claim 7, further comprising:

rotation means or rotationally driving the cylinder when the printing head contacts the cylinder.

9. A method of depositing a hydrophobic material on a nozzle face of an ink jet printing head, comprising steps of:

supporting an applicator comprising a solid hydrophobic material on an ink jet printer adjacent means for supporting a recording medium; and moving the printing head relative to the applicator such that the movement of the printing head relative to the applicator causes the nozzle face of the printing head to slidably contact the applicator to deposit a portion of the solid hydrophobic material comprising the applicator on the nozzle face.

10. The method of claim 9, wherein the applicator is supported on the printer such that the printing head contacts the applicator twice between printing portions of an image, a first time after printing a first portion of the image, and a second time after reversing direction and before printing a second portion of the image.

11. A method of depositing a hydrophobic material on a nozzle face of an ink jet printing head, comprising the steps of:

supporting a cylindrical applicator on an ink jet printer adjacent means for supporting a recording medium, wherein the cylindrical applicator comprises a solid hydrophobic material;

rotationally driving the cylindrical applicator; and moving the printing head relative to the cylindrical applicator so that the nozzle face of the printing head contacts the cylindrical applicator during said movement to deposit a portion of the solid hydrophobic material comprising the cylindrical applicator on the nozzle face of the ink jet printing head.

12. The method of claim 11 wherein a solid hydrophobic material is impregnated in the cylindrical applicator and wherein said contact between the cylindrical applicator and the nozzle face of the ink jet printing head transfers hydrophobic material from the applicator to the nozzle face of the ink jet printing head.

* * * * *